United States Patent [19]

Soler

[11] Patent Number: 4,589,777

[45] Date of Patent: May 20, 1986

[54] MIXING APPARATUS

[76] Inventor: Francis C. Soler, Mt Curl Rd., 2 R.D., Marton, New Zealand

[21] Appl. No.: 625,976

[22] Filed: Jun. 29, 1984

[30] Foreign Application Priority Data

Jul. 4, 1983 [NZ] New Zealand ..... 204797

[51] Int. Cl.[4] ..... B01F 15/04

[52] U.S. Cl. ..... 366/160; 366/162; 366/189; 366/192

[58] Field of Search ..... 4/227, 228; 222/57, 222/67; 366/131, 160, 162, 167, 189, 192, 193

[56] References Cited

U.S. PATENT DOCUMENTS

| | | | |
|---|---|---|---|
| 1,602,554 | 10/1926 | Schrank | 4/227 |
| 3,774,808 | 11/1973 | La Vange | 222/57 |
| 3,874,007 | 4/1975 | Dolan | 4/228 |
| 4,185,653 | 1/1980 | Armstrong et al. | 222/57 |

FOREIGN PATENT DOCUMENTS 1327380 8/1973 United Kingdom .

538905 8/1984 United Kingdom .

*Primary Examiner*—Robert W. Jenkins

*Attorney, Agent, or Firm*—Stevens, Davis, Miller & Mosher

[57] ABSTRACT

The present invention consists in a mixing apparatus for mixing two flowable substances, and preferably oil and petrol, in a desired volumetric ratio. The apparatus includes a first container of predetermined volume and a second container of predetermined volume. These containers have a closable filling means through which the first container can be filled with a first flowable substance and the second container can be filled with a second flowable substance. There is a passage between the containers and a valve means operable to close the passage when the second container is being filled but operable to open the passage, whether or not the second container is filled, when the first container is being filled when the valve means opens the contents of the two containers can pass through the passage and be mixed together.

8 Claims, 2 Drawing Figures

MIXING APPARATUS

BACKGROUND OF THE INVENTION

This invention relates to a mixing apparatus for mixing two flowable substances in a desired volumetric ratio.

The apparatus of this invention has been devised particularly although not solely for the purpose of mixing a predetermined volume of oil with a predetermined volume of petrol to obtain a desired two stroke oil-petrol fuel mixture. Two stroke fuel is much used for many machines and tools make use of a two stroke motor, these including chain saws, lawn mowers and motor cycles for example.

The conventional method of obtaining a desired oil-petrol mixture utilises at least one container and often two containers, for example, if you have a 5 liter can and require an oil-petrol ratio of 1 to 32 then approximately 152 milliliters of oil is required, the balance being petrol. This is obtained by filling a small oil measuring container of the right capacity and emptying this into the 5 liter can and then filling the can with petrol. Alternatively the oil can be poured into the can up to a visible line and then the can topped up with petrol. Problems exist with both of these conventional methods, for example, where a can and separate container are used it is not always easy to find an appropriately sized container for measuring the oil and the container and can can become separated and one of them lost. Where a single can is used having a visible line to which the oil is filled, this usually requires the can to be made of a transparent plastics material so that the oil level can be seen through its wall and some plastics containers are not suitable for the storage of an oil-petrol mixture. It was with problems such as these in mind that the present invention was devised.

SUMMARY OF THE INVENTION

The present invention consists in a mixing apparatus for mixing two flowable substances, and preferably oil and petrol, in a desired volumetric ratio. The apparatus includes a first container of predetermined volume and a second container of predetermined volume. These containers have a closable filling means through which the first container can be filled with a first flowable substance and the second container can be filled with a second flowable substance. There is a passage between the containers and a valve means operable to close the passage when the second container is being filled but operable to open the passage, whether or not the second container is filled, when the first container is being filled when the valve means opens the contents of the two containers can pass through the passage and be mixed together.

Preferably the second container has a smaller volume than, and is fixedly attached inside, the first container.

Preferably each container has its own closable opening.

Preferably the first container has a top end and the second container is attached adjacent to, and the opening to each container is located in, this top end of the first container.

Preferably the passage is provided by an aperture or apertures in the second container which communicate with the first container.

Preferably the operation of the valve means is automatic.

Preferably the valve means is biased to close the passage when the apparatus is upright and the first container is empty or insufficiently filled to cause the valve means to open the passage.

Preferably the valve means includes a float located in the first container which is movable on the sufficient filling of the first container to thereby cause the valve means to open said passage.

Preferably the apparatus is portable.

BRIEF DESCRIPTION OF THE DRAWINGS

The above gives a broad description of the present invention, a preferred embodiment of which will now be described with reference to the accompanying drawings in which.

DETAILED DESCRIPTION OF THE INVENTION

Figure 1:
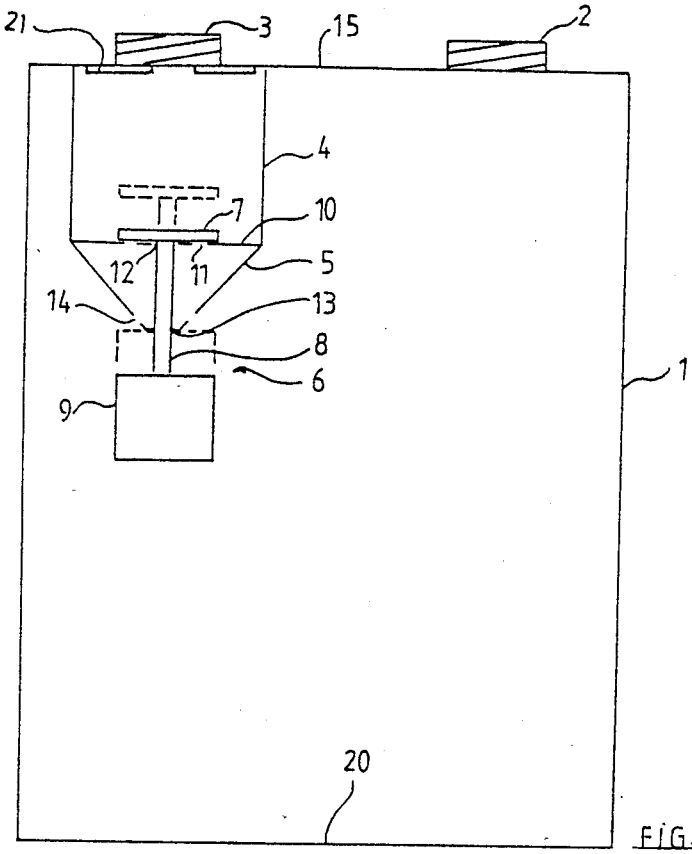
FIG. 1 shows a sectional view in diagrammatic form through the apparatus.

By way of example the preferred embodiment will be described with reference to the mixing of oil with petrol in a ratio of 1 to 32 to make up a 5 liter volume of the mixture. It will be appreciated that other volume ratios and other flowable substances may be mixed by using the mixing apparatus of this invention.

The preferred mixing apparatus has a first container 1 having a volume of about 5 liters or a little more. The container may be made of steel or "tin" and may have a generally rectangular or cylindrical shape as is common for containers used for containing petrol. The container of course could have other shapes and be made from other materials, such as suitable plastics materials. The container illustrated has a top end 15 in which is located a closable opening 2. The opening normally will be closable by means of a screw type cap (not shown).

Located within the first container is a smaller second container 4 having a volume of about 152 milliliters. This second container is preferably fixedly attached adjacent to the top end 15 of the first container and is preferably made of the same material as the first container. In the embodiment of the invention illustrated the second container has its own closable opening 3, this being located in the top end 15 of the first container which also provides the top end of the second container and this opening 3 is also usually closable by means of a screw type cap (not shown).

The second container 4 is shorter in height than the first container and has a base 10 which has one or more apertures 11 in it and a central hole 12. The apertures 11 form part of a passage communicating between the two containers. This passage is opened and closed by the operation of a valve means 6.

The preferred valve means 6 comprises a disc type valve 7 located within the second container, a float 9 located within the first container and a valve stem 8 joining the two. Beneath the second container 4 there is a conical arrangement 5 or a strap which together with the base 10 of the second container provides a guide for the valve stem. At the apex of the cone or strap there is a hole 13 and the valve stem passes through this hole 13 and through the hole 12 in the base 10 of the second container and is slidable in these holes. Adjacent the apex of the cone there are apertures 14 which form part of the passage whereby the second container is in communication with the first container. If a strap is used this is open at its sides. With the arrangement illustrated the valve means 6 is movable from a closed portion shown in solid outline to an open position shown in dashed outline. In the closed position the valve 7 closes the apertures 11 and hole 12 in the base 10 of the second container and thus closes the passage between the two containers. However, when the valve means is in its open position the valve 7 is clear of the apertures 11 and the passage is open. The valve disk 7 may have other than a circular shape.

In use of the mixing apparatus this is preferably stood in a substantially upright position and the second container 4 is first filled with oil through its opening 3. The valve means is closed by its weight pulling the valve 7 down against the base 10 of the second container. Also the weight of the oil above the valve 7 assists in this respect. Therefore the oil is retained in the second container so that when this container is filled it is known that there is the required quantity of oil. Secondly, the first container 1 is filled with petrol through its opening 2. As the level of the petrol in the first container 1 rises and starts immersing the float 9 of the valve means 6, the valve means 6 is lifted as a result of the buoyancy of the float, thereby moving towards its open position and opening the passage. As more petrol is poured into the first container 1 to fill it, the oil, because of its greater density, tends to flow through the passage from the second container to the first container and also, as the petrol level rises sufficiently, petrol tends to flow from the first container through the passage and into the second container. When the first container is filled then it is known that the apparatus contains the required quantity of petrol for the desired oil-petrol ratio of the fuel mixture. The openings 2 and 3 of the apparatus are closed by their caps and the apparatus may then be shaken vigorously to ensure a thorough mixing of the petrol and oil. This is possible where the apparatus is portable as is preferred and illustrated. In this case a carrying handle may be provided attached to the container. However the apparatus may be of a larger capacity and fixed in position in which case a separate stirring means or apparatus may be provided for ensuring that the two flowable substances are thoroughly mixed.

Figure 2:
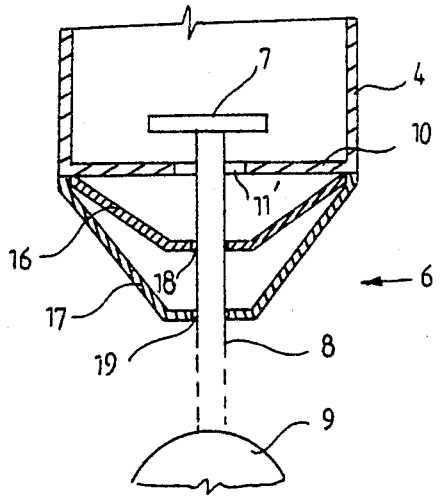
FIG. 2 shows a modified valve means.

A slightly modified valve means is shown in FIG. 2 when compared with the valve means of FIG. 1. In this embodiment there are two straps 16 and 17 disposed below the bottom 10 of the second container 4 and attached thereto. These two straps provide a guide for the valve stem 8 of the valve means 6. Each strap has a hole 18 and 19 respectively through which the valve stem slidably passes. With this arrangement there is no need for the bottom 10 of the second container to function as a guide also, and in this case the bottom 10 has a single central hole 11' in it which forms part of the passage between the first and second containers. The hole 11' has a smaller diameter than that of the valve 7 but a larger diameter than that of the valve stem, so that it is closed or open according to whether the valve 7 is located against the bottom 10 of the second container or is lifted up from the bottom.

In the embodiment of the valve means shown in FIG. 1 the valve stem 8 is relatively short. However, the valve stem may be made much longer so that when the first container is empty and the valve means is in its closed position the float 9 is located close to, but preferably a little above, the bottom of 20 of the first container. This means that soon after commencing the filling of the first container the valve means commences opening. The valve means of FIG. 1 shows the float 9 having a box or a cylindrical shape but it may have other shapes, for example, a spherical shape, a portion of which is shown in FIG. 2. The float may be made of various materials but a hard nylon has been found to be quite suitable.

Where the second container 4 is attached to the top 15 of the first container 1 as shown in FIG. 1 and where the containers are made of a metal such as steel they may be spot welded or soldered together. It is desirable that about the top periphery of the second container where this is attached to the top of the first container, the second container has one or more small apertures 21. Such apertures allow the oil-petrol mixture in the second container to drain from this and into the first container when the first container is being tipped on its side or upside down for emptying the oil-petrol mixture through the opening 2 of the first container, the opening 3 then being closed by its cap. Of course oil-petrol mixture could be poured from the first container via the second container through the opening 3. When the oil petrol mixture is being poured from either of the openings 2 or 3 the other opening may be closed or, provided that the first container is not too full whereupon oil-petrol mixture would pour from both openings 2 and 3 if their caps were removed and the apparatus lifted, both caps may be removed so that air is permitted to enter the containers as they empty of the oil-petrol mixture. This allows the oil-petrol mixture to be poured from the containers in a continuous flow uninterrupted by air or pressure surges.

The above describes the preferred form of the invention and indicates some possible modifications but various other modifications may be made without departing from the scope of the invention as broadly defined. An advantage of the valve means of the preferred embodiment is that it operates automatically and also operates satisfactorily provided that it is the second container that is filled first. However a manually operated valve means may be used instead in which case it need not matter which of the containers is first filled. The apparatus can have alternative filling means. For example, there may be a single spout through which the containers are filled and emptied, the spout opening to both the first and second containers. In this case a manually operated valve would be provided to enable the opening of the spout to either one of the containers to be opened while that to the other container is closed. Such a valve could comprise a plate secured to the top 15 and slidable over one or the other of openings to the first or second containers, the valve plate being moved by means of a lever projecting from the side of the spout or perhaps by rotation of the spout. The second container could be located outside the first container, being either fixed to or separate from the first container, and a hose or pipe can be used to connect the two, though such an arrangement, unless required for special reasons, is obviously not preferred in view of its greater inconvenience of use. The apparatus may be used for mixing chemicals. While the flowable substances will usually be liquids this is not necessarily the case, for example, the second container 4 could contain a flowable powder to be mixed with a liquid in the first container.

It is envisaged that ranges of differently sized containers will be produced, for example, in 5, 10 and 15 liter capacities. For each sized container, different ratios will be provided for, for example, 1:20, 1:25, 1:32 ratios, these being common oil-petrol ratios.

I claim:

1. A portable apparatus for mixing two liquids in a desired volumetric ratio, the apparatus comprising:

an outer container with a permanently fixed top end; an inner container of smaller volume within the outer container and permanently fixed to the underside of the top end; two filling openings in the top end with each opening provided with a closure, one opening leading directly into the outer container and the other directly into the inner container; a passage in the bottom of the inner container; and a float-operated valve mechanism which does not control either filling opening but controls the passage in such a way that the passage is closed when the outer container is empty, but is opened and remains open to allow liquid in the inner container to be discharged into the outer container as the outer container is filled with liquid.

2. A mixing apparatus as claimed in claim 1 wherein the opening of the passage takes place before the level of the liquid in the outer container has reached the passage so that the liquid in the inner container runs into the outer container.

3. A mixing apparatus as claimed in claim 2 wherein the inner container has at least one aperture adjacent the top end of the outer container.

4. A mixing apparatus as claimed in claim 1 wherein the float-operated valve mechanism has a valve stem with the float at one end within the outer container and a valve disk at the other end within the inner container, the valve stem being slidably supported in guides and movable with movement of the float to move the valve disk between a position closing the passage and a position opening the passage.

5. A mixing apparatus as claimed in claim 1 wherein the outer container is a metal can.

6. A mixing apparatus as claimed in claim 5 wherein the inner container is made of metal and is welded to the top end of the outer container.

7. A mixing apparatus as claimed in claim 6 wherein the closures are screw caps.

8. A portable apparatus for mixing two liquids in a desired volumetric ratio, the apparatus comprising:

a metal can with a permanently fixed top end;

an inner metal container of smaller volume within the can and welded to the underside of the top end;

two filling openings in the top end with each opening provided with a screw-cap, one opening leading directly into the can and the other directly into the inner container;

a passage in the bottom of the inner container; and a float-operated valve mechanism which does not control either filling opening but controls the passage in such a way that the passage is closed when the can is empty, but is opened and remains open to allow liquid in the inner container to be discharged into the can as the can is filled with liquid, the opening of the passage taking place before the level of liquid in the can has reached the passage so that the liquid in the inner container runs into the can.

* * * * *